US006059701A

United States Patent [19]

George et al.

[11] Patent Number: 6,059,701

[45] Date of Patent: May 9, 2000

[54] APPARATUS FOR EXERCISING THE LOWER BACK

[75] Inventors: Gerald Stephen George; Michael Millard Luquette, both of Rayne, La.

[73] Assignee: Cline Children Class Trust, Rayne, La.

[21] Appl. No.: 08/245,870

[22] Filed: May 19, 1994

[51] Int. Cl.[7] ..... A63B 23/02; A63B 21/062

[52] U.S. Cl. ..... 482/137; 482/100; 482/142; 482/145

[58] Field of Search ..... 482/100–103, 482/132, 139, 133–137, 140, 142, 145, 907, 92, 93, 98, 99; 297/423.11, 423.12

[56] References Cited

U.S. PATENT DOCUMENTS

| | | | |
|---|---|---|---|
| 3,858,873 | 1/1975 | Jones . | |
| 4,200,279 | 4/1980 | Lambert, Jr. . | |
| 4,240,626 | 12/1980 | Lambert, Jr. . | |
| 4,387,893 | 6/1983 | Baldwin . | |
| 4,387,894 | 6/1983 | Baumann | 482/139 |
| 4,456,245 | 6/1984 | Baldwin . | |
| 4,462,252 | 7/1984 | Smidt et al. . | |
| 4,478,411 | 10/1984 | Baldwin . | |
| 4,493,485 | 1/1985 | Jones . | |
| 4,500,089 | 2/1985 | Jones . | |
| 4,511,137 | 4/1985 | Jones . | |
| 4,521,013 | 6/1985 | Dofel . | |
| 4,589,656 | 5/1986 | Baldwin . | |
| 4,600,189 | 7/1986 | Olschansky et al. . | |
| 4,600,196 | 7/1986 | Jones . | |
| 4,623,144 | 11/1986 | Rockwell . | |
| 4,627,619 | 12/1986 | Rockwell et al. . | |
| 4,666,152 | 5/1987 | Jones . | |
| 4,733,860 | 3/1988 | Steffee . | |
| 4,753,126 | 6/1988 | Sammaratano | 482/137 |
| 4,763,897 | 8/1988 | Yakata . | |
| 4,809,973 | 3/1989 | Johns . | |
| 4,842,271 | 6/1989 | Vinciguerra . | |
| 4,854,578 | 8/1989 | Fulks . | |
| 4,858,919 | 8/1989 | Jones . | |
| 4,867,142 | 9/1989 | Jones | 482/907 |
| 4,902,008 | 2/1990 | Jones . | |
| 4,902,009 | 2/1990 | Jones . | |
| 4,911,435 | 3/1990 | Johns . | |
| 5,005,830 | 4/1991 | Jones . | |
| 5,007,634 | 4/1991 | Jones . | |
| 5,039,092 | 8/1991 | Olschansky et al. . | |
| 5,056,779 | 10/1991 | Webb . | |
| 5,074,551 | 12/1991 | Olschansky et al. . | |
| 5,092,590 | 3/1992 | Jones . | |
| 5,094,249 | 3/1992 | Marras et al. | 482/134 |
| 5,104,121 | 4/1992 | Webb . | |
| 5,104,364 | 4/1992 | Jones | 482/100 |
| 5,106,081 | 4/1992 | Webb . | |
| 5,106,083 | 4/1992 | Hall | 482/145 |
| 5,110,121 | 5/1992 | Foster . | |
| 5,125,881 | 6/1992 | Jones . | |
| 5,135,449 | 8/1992 | Jones . | |
| 5,135,456 | 8/1992 | Jones . | |
| 5,171,198 | 12/1992 | Jones . | |
| 5,171,200 | 12/1992 | Jones . | |
| 5,180,354 | 1/1993 | Jones . | |
| 5,269,738 | 12/1993 | Boren . | |
| 5,322,489 | 6/1994 | Webb et al. . | |

OTHER PUBLICATIONS

Body Masters Sports Industry, Inc. advertisement appearing in "Mr. America" program, 1979.

Dynamics Health Equipment Manufacturing Co., Inc. Price List, dated Dec. 1, 1977, two pages.

Dynamics Health Equipment Manufacturing Co., Inc. product brochure re "Dynacam", 1977, two pages.

*Primary Examiner*—Richard J. Apley

*Assistant Examiner*—Victor K. Hwang

*Attorney, Agent, or Firm*—Kennedy Covington Lobdell & Hickman, L.L.P.

[57] ABSTRACT

An apparatus for exercising the lower back muscles of a user includes a frame, an arrangement mounted to the frame for resisting forward movement of the user's hips while maintaining the user's gluteus maximus and hamstring muscles in a relatively relaxed condition, a lever assembly mounted to the frame in a disposition for engagement by the upper back of a user for backward and forward user induced movement of the lever assembly for exercise of the user's lower back muscles and a resistance assembly operatively connected to the lever assembly for resisting the user induced exercise movement with a predetermined resistive force.

18 Claims, 11 Drawing Sheets

APPARATUS FOR EXERCISING THE LOWER BACK

BACKGROUND OF THE INVENTION

The present invention relates broadly to exercise machines and, more particularly to an exercise machine wherein the user kneels to operate a weightlifting system to exercise the muscles of the lower back, particularly the spinae erector group.

Typical exercise machines include a frame supporting some form of body support, a set of moveable weights and a system to allow the user to move the weights. Currently, most exercise machines are particularly configured to exercise specific muscle groups. The present invention is directed to a specialized exercise machine for exercising the lower back muscle group. Prior lower back exercise machines typically provide a seat for supporting the user in a seated position providing access to a lever which is operated by the user leaning backwardly to lift the weights. The seated position offers little support against movement of the body and thereby does not effectively isolate the muscles of the lower back. An example of this machine is disclosed in Jones, U.S. Pat. No. 4,500,089.

As a consequence of not thoroughly isolating the lower back muscles, the current machines do not exercise the lower back muscles isotonicly but rather provide an isometric exercise. With isometric exercise, opposing muscles are so contracted that there is little shortening of the muscle tissue but an increase in the tone of the muscles. An isotonic exercise provides muscle contraction in the absence of significant resistance, with a mark shortening of muscle fibers and without a significant increase in muscle tone. Current machines maintain relaxation of the back, trunk and pelvis to stabilize the back and move at the hip joint providing only isometric exercise. Therefore, the muscles of the lower back are exercised only secondarily.

Currently, there is a need for a machine to properly isolate the lower back to primarily exercise the spinae erector group in an isotonic manner.

SUMMARY OF THE INVENTION

It is accordingly an object of the present invention to provide an exercise machine for both fitness and therapeutic use which isolates the spinae erector group for targeted exercise. It is further an object of the present invention to provide such an exercise machine which will provide exercise of the lower back isotonically. It is an additional object of the present invention to provide such a machine in a conventional exercise machine format which can be used with conventional weight movement apparatus.

To that end, an apparatus for exercising the lower back muscles of the user includes a frame, an apparatus mounted to the frame for resisting forward movement of the user's hips to maintain the user's gluteus maximus in a relaxed condition and an apparatus for maintaining the user's knees in a flexed condition for maintaining the user's hamstring muscles in a relaxed condition. Also included is a lever assembly mounted to the frame at a disposition for engagement by the upper back of a user for backward and forward user-induced movement of the lever assembly for exercise of the user's lower back muscles with the gluteus maximus and hamstring muscles in a relatively relaxed condition, and a resistance arrangement operatively connected to the lever assembly for resisting the user-induced exercise movement with a predetermined resistance force. Preferably, the lever arrangement is mounted to the frame for pivoting about a pivot axis and the pivot axis is positioned adjacent the lumbar region of the user when operating the apparatus. Further, the movement resisting arrangement includes a member mounted to the frame and disposed for engagement by the front of the pelvic girdle area of a user to block substantial forward movement of the user when operating the apparatus. Preferably, the movement resisting member extends sufficiently to contact the thighs of a user for reduced loading at the pelvic girdle during exercise. It is further preferred that the present invention include an arrangement mounted to the frame engageable by the user for stabilizing the user during user-induced movement of the lever assembly. This stabilizing arrangement includes hand engageable members mounted to the lever arrangement for pivoting with the lever assembly about the pivot axis, the hand engageable member being disposed for engagement by the hands of a user to stabilize the upper body of the user when operating the lever assembly.

It is preferred that the present invention include an assembly mounted to the frame at a disposition for engagement by the front portions of the user's legs above and adjacent the knees of the user to facilitate stabilization of the user's legs when operating the present invention. Preferably, the lever arrangement includes an arrangement for selectively limiting the range of pivoting movement of the lever arrangement. By the above, the present invention provides an apparatus of relatively simple construction which positions the user in a predetermined manner to isolate the muscles of the spinae erector group for isotonic exercise thereof. The unique positioning of the user allows a conventional weight moving system to be operated by the user to provide effective and concentrated exercise of the spinae erector group to achieve muscle strength in this area in a safe, time effective manner.

DETAIL DESCRIPTION OF THE PREFERRED EMBODIMENT

Figure 1:
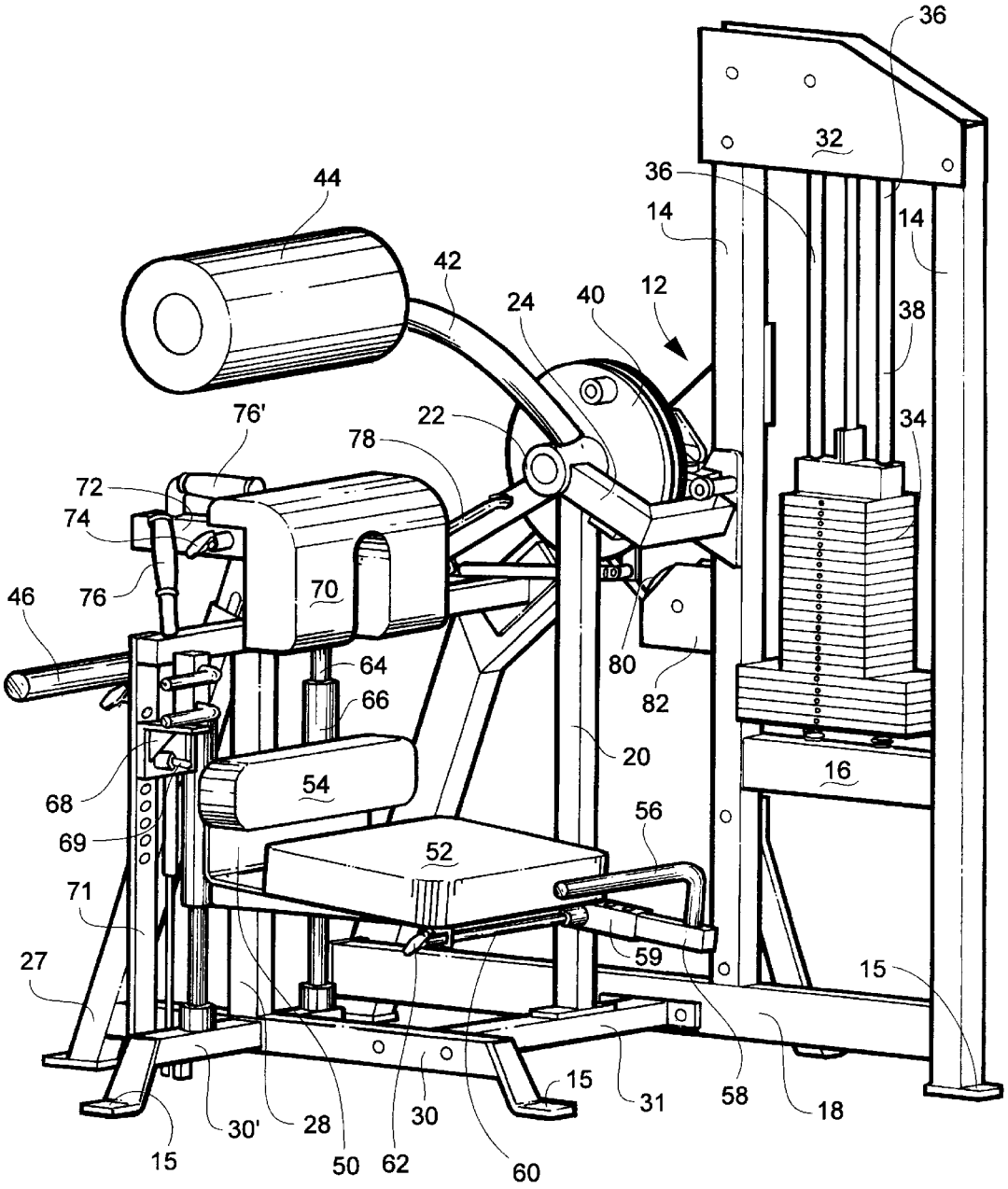
FIG. 1 is a perspective view of the apparatus for exercising the lower back according to the present invention illustrating the user support area.

Turning now to the drawings, the structure of the present invention is best seen in FIGS. 1–6, an apparatus for exercising the lower back is illustrated generally at 10 and includes a frame 12 formed of interconnecting bar like members formed, preferably, of steel to provide support for a weight system, the weight control system, and the body support system, each of which will be described in greater detail hereinafter. The frame 12 includes a primary horizontal cross member 18 disposed adjacent the floor with two spaced, parallel vertical weight support members 14 projecting upwardly therefrom at one end thereof. A horizontal cross member 16 extends between the weight support members 14 and is mounted thereto a distance of approximately one-third the length of the vertical weight support members 14 from the floor. The horizontal cross member 16 provides the primary support for a stack of weight elements 34. The weight elements 34 will be explained in greater detail hereinafter. A first primary angular support member 26 extends from a position located a distance from the floor of approximately two-thirds of the length of one of the vertical weight support members 14, angularly downwardly to the opposite end of the primary horizontal cross member 18. The weight support section of the frame provides the primary structure of the frame 12 and extends generally in a single, vertical plane.

The first primary angular support member 26 includes the mounting assembly for the control levers 42,46 of the exercise apparatus 10 of the present invention. The control levers 42,46 themselves will be explained in greater detail hereinafter. To support the control levers 42,46, an arrangement of horizontally and angularly projecting support members 24 projects outwardly from the vertical weight support bar 14 adjacent its junction with the first angular support member 26. A vertical control lever support member 20 projects upwardly into a joining relation with the angularly disposed support member 24. A hub 22 is fitted at this junction. A camming wheel 40 is attached to the hub 22 for rotational movement thereabout.

The body support portion of the frame 12 projects generally perpendicularly away from the weight and control lever support portions of the frame 12. A first horizontally oriented support bar 31 projects outwardly from the primary horizontal cross member 18 in a generally perpendicular relationship therewith. The lower end of the vertical control lever support member 20 is mounted to the first horizontally oriented cross member 31. A primary body support cross member 30 is mounted to the first horizontal support bar 31 in a generally perpendicular relationship therewith and extends in a generally parallel relationship with the primary horizontal cross member 18. A primary vertically oriented support member 28 projects upwardly from the primary body support cross member 30 from a position spaced from the first horizontal support support bar 31. An angular pelvic pad support bar 27 projects upwardly from the endmost portion of the primary body support cross member 30. The entire frame 12 is supported by a plurality of generally planar, relatively thin foot members 15 disposed at the end points of the primary support members for supporting the apparatus 10 on a floor or other support surface.

Returning now to the weight system, a plurality of weight elements 34 are formed generally as rectangles and are stacked intermediate the two vertical weight support members 14. The weight elements themselves 34 have a plurality of openings (not shown) formed completely therethrough and when the weight elements 34 are in their stacked relationship, the openings are in registry. Two parallel weight guide shafts 36 project through the aforesaid openings and extend from the horizontal weight cross member 16 upwardly to the termination of the vertical weight support members 14 adjacent weight control pulleys 80 which will be discussed in greater detail hereinafter. Each weight element 34 also includes a plurality of generally horizontally oriented openings for insertion therein of a weight selection rod (not shown) for selecting the desired weight value for exercise. The weights elements 34 also have thereattached a strap 38 which is operatively connected to the control levers 42,46 for raising the weight elements 34 in response to control lever 42,46 movement. The weight system of the present invention is generally known throughout the exercise industry and, as is also well known, other resistance providing systems, such as elastic bands or other resistance devices may be used without departing from the spirit and intention of the present invention.

Figure 2:
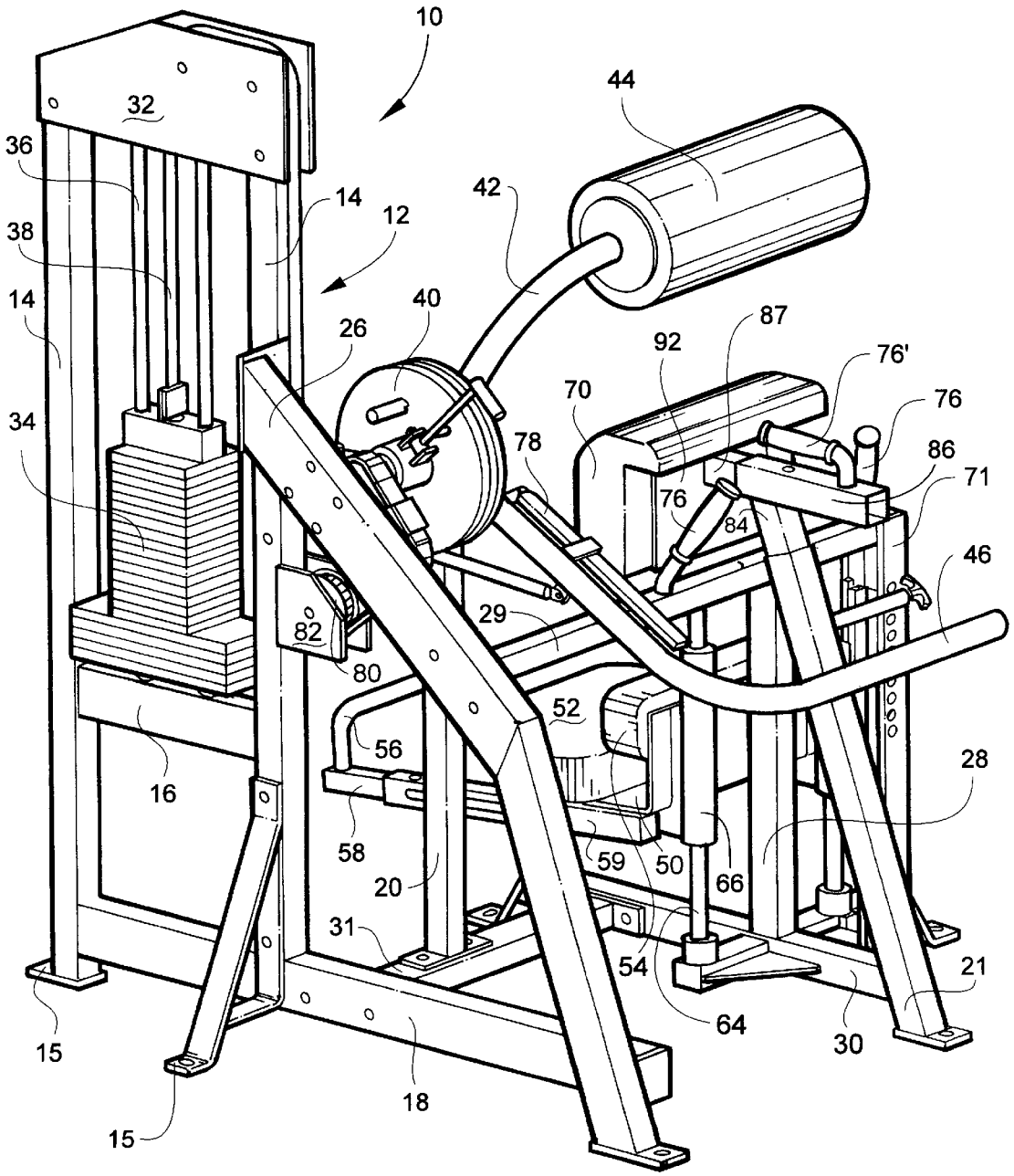
FIG. 2 is a perspective view of the apparatus illustrated in FIG. 1 showing the opposite side.

In order to control the weights and conduct an exercise, the strap 38 is routed through a series of pulleys 80 to the camming wheel 40. The strap 38 traces a circuitous path from the weight elements 34 over pulleys 80, which are covered by a plate member 32, down an adjacent vertical weight support member 14 around an additional pulley 80' supported on the vertical weight support member 14 by a platelike pulley mount 82, to its junction with the camming wheel 40, as best seen in FIG. 2.

Figure 3:
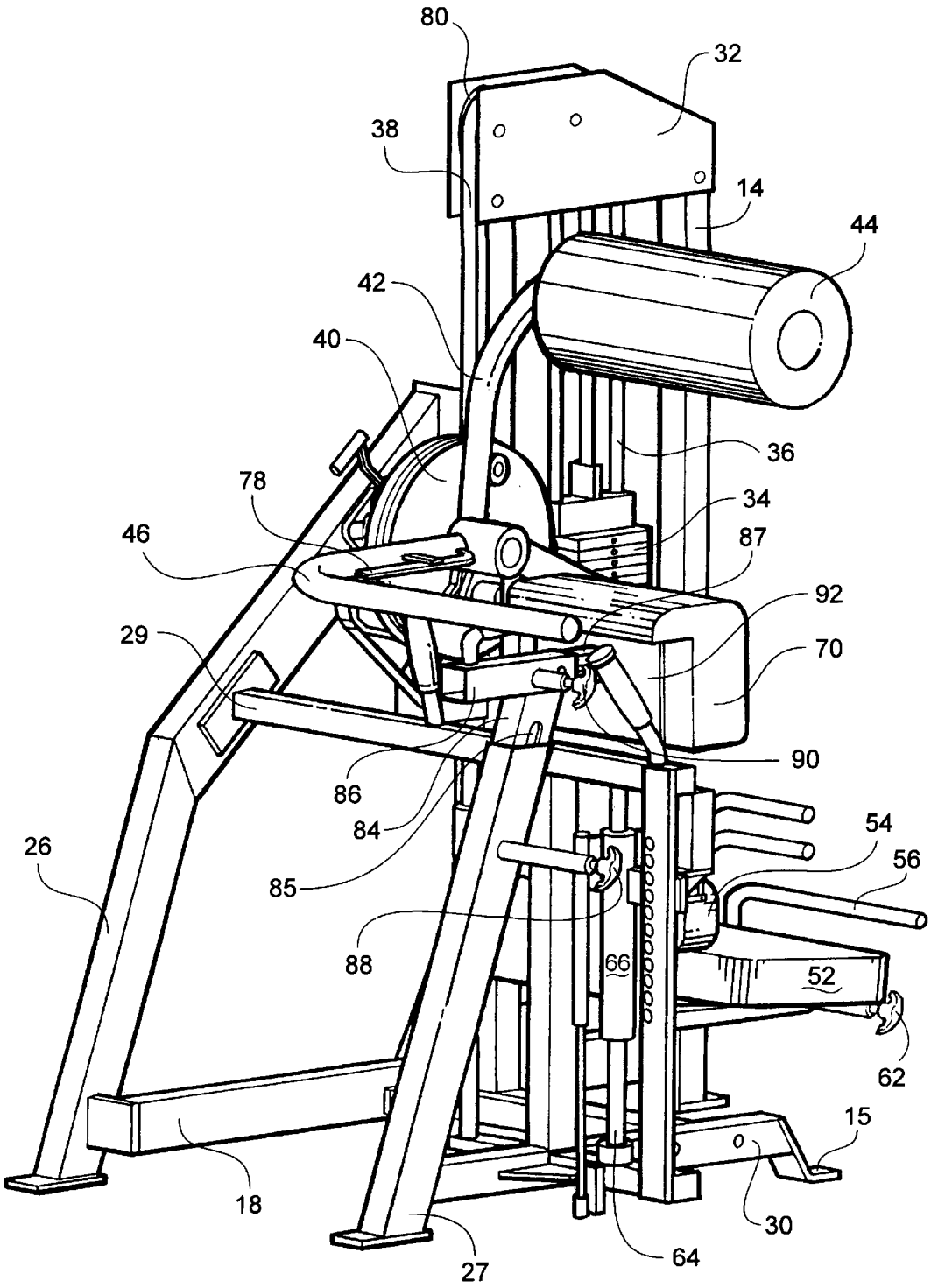
FIG. 3 is a perspective view of the exercise apparatus illustrated in FIG. 1 from the frontal area of the machine.
Figure 4:
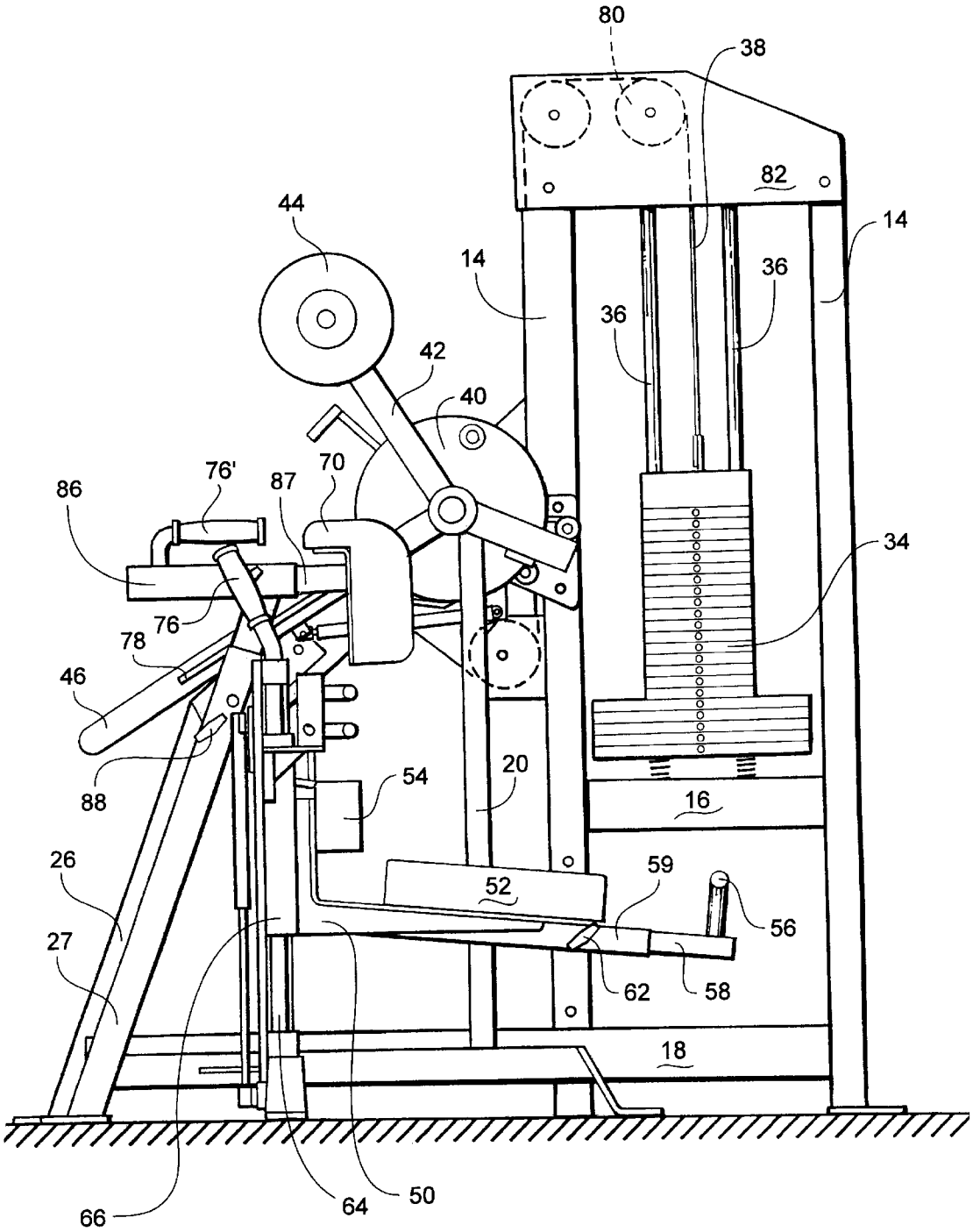
FIG. 4 is a left side view of the exercise apparatus illustrated in FIG. 1.
Figure 5:
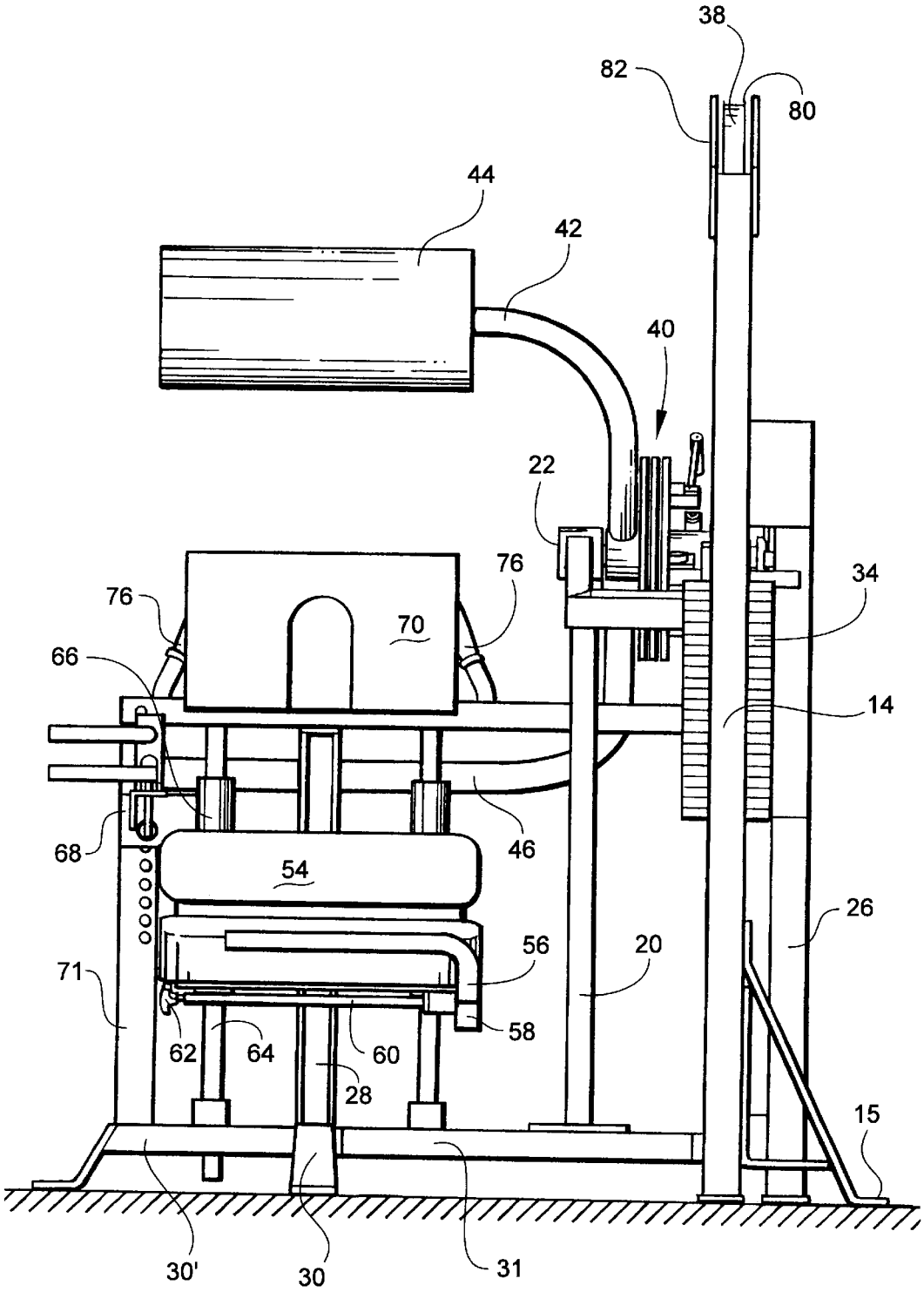
FIG. 5 is a rear view of the exercise apparatus illustrated in FIG. 1.
Figure 6:
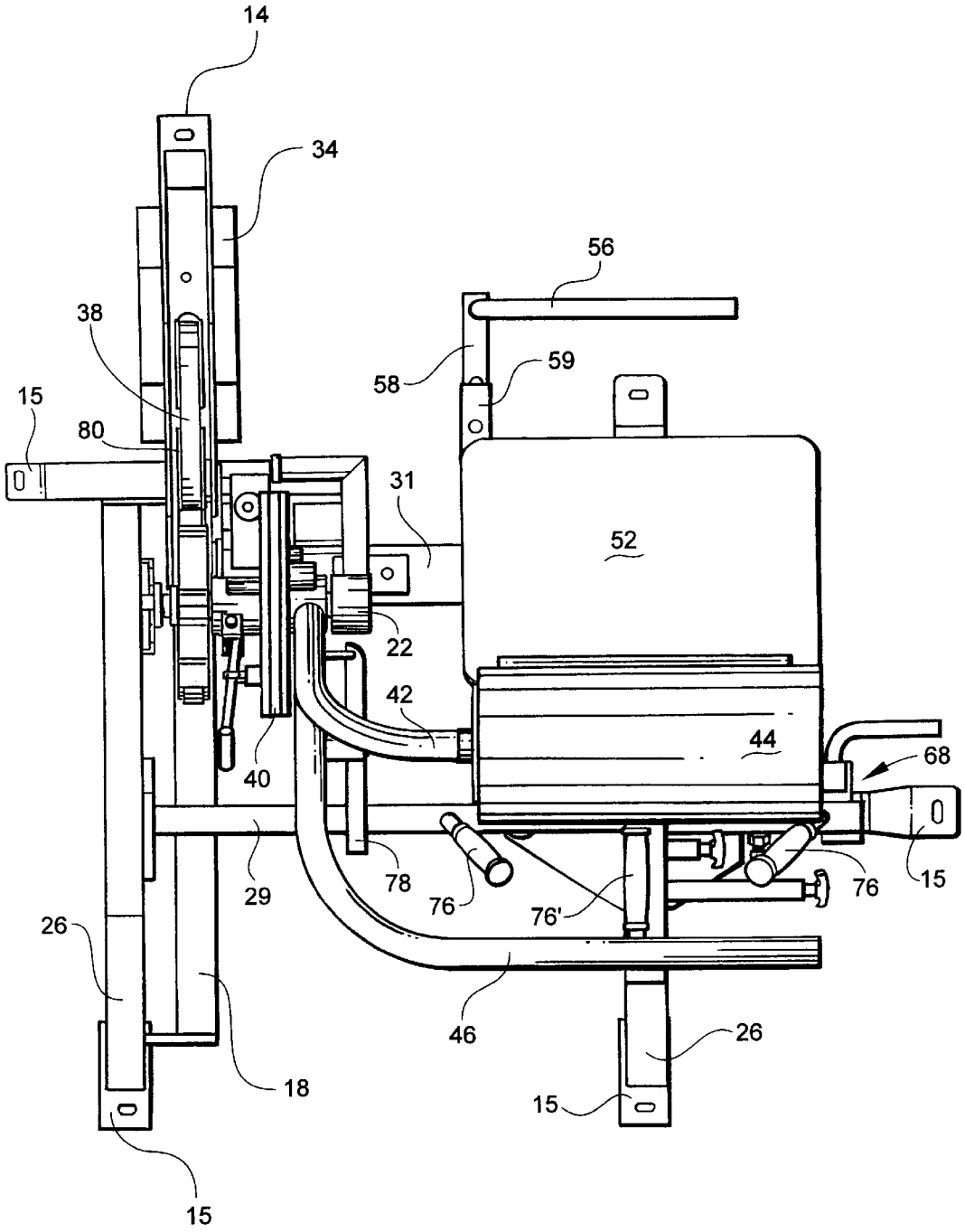
FIG. 6 is a top plan view of the exercise apparatus illustrated in FIG. 1.

The control lever system includes the aforesaid camming wheel 40 attached to a hub 22 which is rotatably mounted to the frame 12 at the vertical control lever support member 20. The camming wheel 40 is a generally circular disk having two generally curved control rods 42, 46 projecting outwardly therefrom at an angular relationship of approximately 90°. As best seen in FIGS. 2, 3 and 6, a first back engaging control lever 42 is curved sweepingly through 90° from a position at its junction with the hub 22 to a terminal position projecting outwardly over the body support area. A generally hollow, cylindrical back pad 44 is disposed on the distal end of the back engaging lever 42. A similarly shaped arm support member 46 projects outwardly from the hub 22 to a position outwardly and forwardly of the body support area. The control portions of the levers 42,46 extend in a generally parallel relationship with one another and a generally perpendicular relationship with the primary horizontal cross member 18. As will be seen, when the control levers 42,46 are moved, the camming wheel 40 attached thereto rotates at the hub 22 to cause movement of the strap 38 and, through the series of pulleys 80, the weight elements 34 are raised.

In order to properly utilize the present invention to exercise, a technique which will be discussed in greater detail hereinafter, a uniquely formed body support system is provided. In order to isolate the spinae erector muscle group, the present invention provides a body support which supports the exerciser in a kneeling stance which puts the exerciser's hamstring and gluteus maximus muscles in a relaxed condition and prevents forward movement of the body to isolate and isotonically exercise the lower back muscles or spinae erector group.

To that end, a kneeling platform 50 is provided. To mount the kneeling platform 50 to the frame 12, a pair of shafts 64 extend from horizontal body support cross members 30' which extend outwardly from the primary body support cross member 30. The kneeling platform 50 is mounted to a pair of sleeves 66 which encircle the shafts 64 for sliding movement thereon. The kneeling platform 50 is formed as a generally curved, planar member, a portion of which extends upwardly from its mount in a generally parallel relation with the sleeves 66, and a portion of which extends outwardly in a cantilevered manner from the sleeves 66. A kneeling pad 52 is mounted to the kneeling platform 50 in a generally horizontal fashion for support of a user's lower legs. A knee pad 54 is mounted to the vertical portion of the kneeling platform 50 to protect the user's knees from abutment with the sleeves 66. The kneeling platform 50 is adjustably mounted using a latching arrangement 68 which includes a plate adjustably mounted to a vertical support member 71 which extends between a lower horizontal body support cross member 30' and the upper horizontal cross member 29. The plurality of openings are formed in the vertical support member 71 and an adjustment rod 69 is selectively positionable in one of the openings to position the kneeling platform 50 at a plurality of vertical positions to adjust the platform position to fit the physical requirements of the exerciser.

In order to properly isolate the lower back muscles, the hip area, specifically, the pelvic girdle, of the user is prevented from forward movement by a uniquely configured hip pad 70. As seen in FIG. 1, the hip pad 70 includes two downwardly projecting portions and an upper curved portion to fit the contours of the user. The downwardly projecting portions are provided for engagement with a user's thighs and the upper curved portion engages the user's abdomen for comfortable movement prevention. The mounting arrangement of the hip pad 70 is best seen in FIG. 3. To that end, the angular pelvic pad support bar 27 extends upwardly to a position where it engages the upper horizontal cross member 29. This angular pelvic pad support bar 27 is hollow and includes a vertical hip pad support member 84 fitted therein in a telescoping relationship. A slot 85 is formed in the vertical hip pad support member 84 and an engagement rod (not shown) is fitted to the angular pelvic pad support bar 27 for engagement with the slot 85. Tightening of the vertical hip support member 84 is accomplished using a T-handle 88 attached to the engagement rod. A horizontally oriented hip pad support bar 86 is mounted to the end portion of the vertical hip pad, support member 84 and also includes a similarly arranged telescoping member 87 which includes a similar locking arrangement controlled by a T-handle 90. At the end of the horizontal telescoping member 87, a generally planar, vertically oriented plate 92 supports the hip pad 70. By loosening the T-handles 88,90 and sliding the telescoping members 84,87 within their mounts, the hip pad 70 may be adjusted in both a vertical and horizontal manner to fit the physical requirements of the user.

In order to provide additional stabilization of the user in an exercise position, a foot abutment bar 56 is provided. This foot bar 56 is mounted to the underside of the kneeling platform 50 and projects outwardly therefrom. The foot bar 56 is mounted to a foot bar support member 58 which is telescoped into a supporting channel 59. Openings are provided along the length of the foot bar support member 58 and a rod 60 is provided for insertion therein. Control of the rod 60 is provided by a T-handle 62 projecting outwardly from one side of the kneeling platform for easy access by the user. By releasing the control rod 60, the foot bar support member 58 may slide inwardly and outwardly in a telescoping fashion to the desired position wherein the control rod 60 may engage one of the openings to retain the foot support bar 56 in the desired position. Further stabilization of the user is provided by a plurality of handles 76,76' projecting outwardly from the frame 12 at positions necessary for gripping by the user. A pair of vertically oriented handles 76 project outwardly from the upper horizontal crossbar 29 at positions on either side of the hip pad 70. A generally horizontally oriented handle 76' projects outwardly from the horizontal hip pad support bar 86. These handles may be gripped by a user during exercise movement.

In order to further arrange the device to fit the physical requirements of a user, a range limiter is provided to limit the arc of travel defined by movement of the control levers 46,42 about the hub 22. To that end, a range limiter lever 78 is pivotally mounted to the frontal control lever 46 along a side thereof adjacent the camming wheel 40. The lever 78 engages openings (not shown) in the camming wheel to position the orientation of the control levers at whatever position is desired or required by the exerciser. It should be noted that range of motion limiters are well known in the art and any of a number of configurations may be employed with equal range-limiting effectiveness.

The unique configuration of the exercise machine of the present invention may be more fully appreciated by an examination of its operation by an exerciser. Referring now to FIGS. 7–11, operation of the present invention will be explained. The key to proper use of the machine for both fitness and therapeutic purposes is to assume the correct exercising stance and adjust the various adjustments provided, and previously discussed, to fit the physical requirements of the user.

Figure 7:
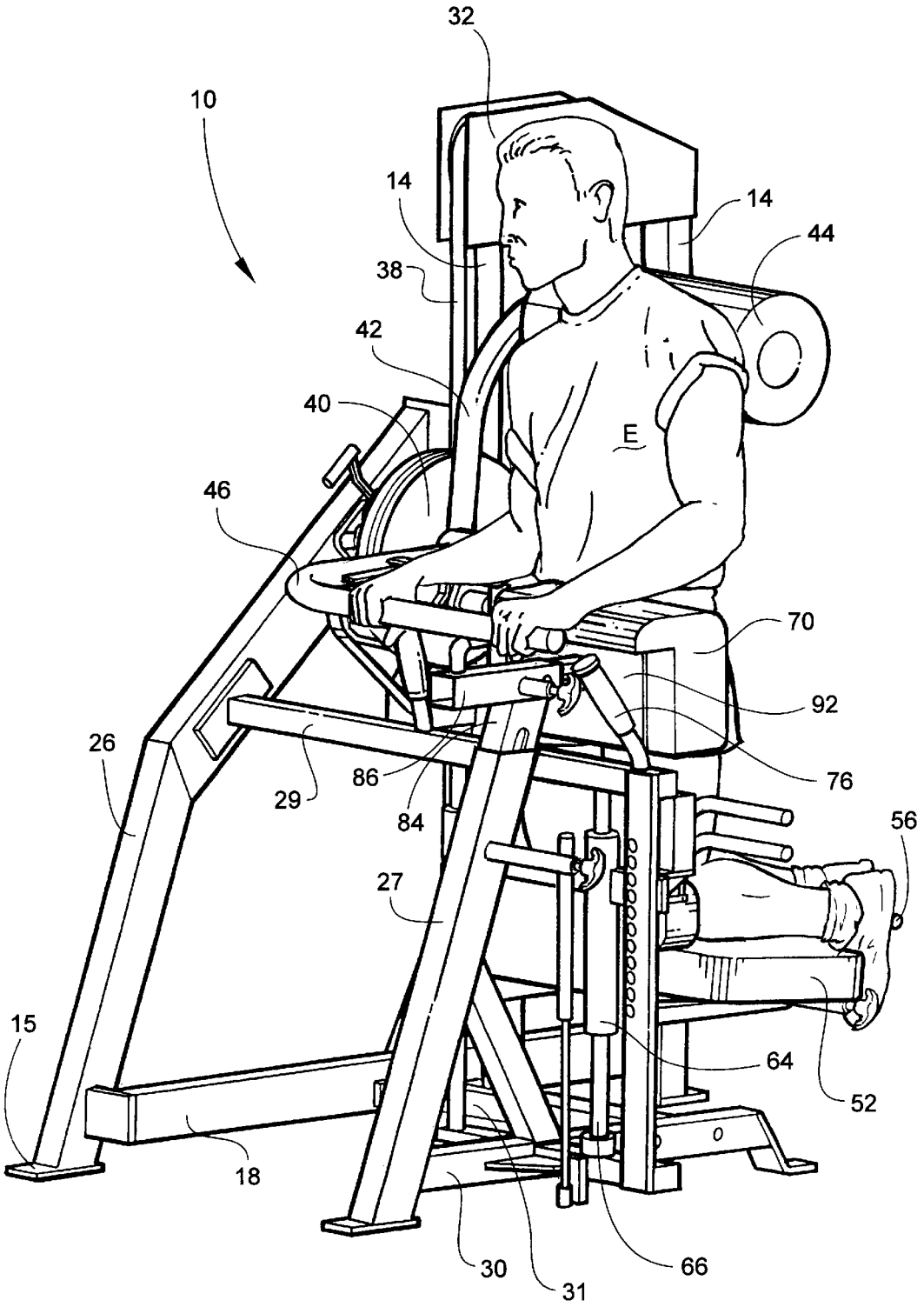
FIG. 7 is a frontal perspective view of the exercise apparatus of the present invention illustrating its preferred manner of use.
Figure 8:
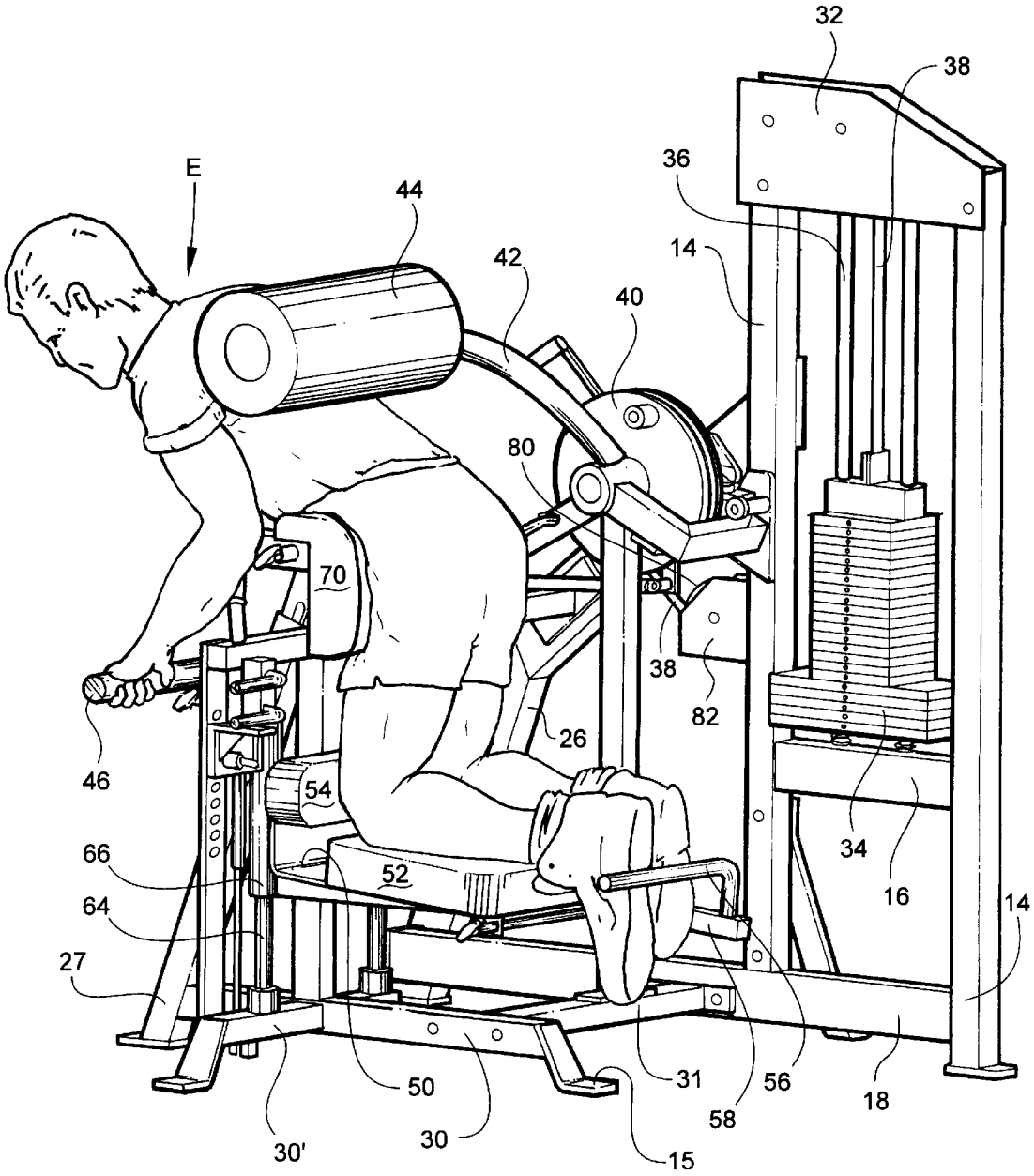
FIG. 8 is a rearwardly directed perspective view of the exercise apparatus of FIG. 7.

As seen in FIG. 7, an exerciser E is supported within the frame structure of the apparatus 10 of the present invention. The exerciser E is supported by kneeling with his lower legs extending across the kneeling pad 52 with his feet against the foot bar 56. The foot bar 56 pictured in FIG. 8 has been adjusted in a manner previously described to engage the bottom of a user's feet when the user's knees are adjacent, but not necessarily in contact with, the knee pad 54. The kneeling support pad 52 supports the majority of the user's lower legs. The pelvic girdle area of the exerciser E is engaged with the hip pad 70 to isolate the pelvic girdle area. In this manner, the gluteus maximus muscles as well as the hamstring muscles of the exerciser E are relatively relaxed. The upper body of the user extends vertically between the control levers 42,46 with the shoulder blade area of the upper back engaged with the back pad 44 of the rearward control lever 42. For stabilization, the user may grip the frontal support lever 46 in a manner shown in FIG. 7. The auxiliary handles 76,76' are for stabilization during ingress and egress from the apparatus or for emergencies. The proper stance to begin the exercise is pictured in FIG. 8 with the pivot axis of the camming wheel 40 adjacent the lumbar region of the user.

Figure 9:
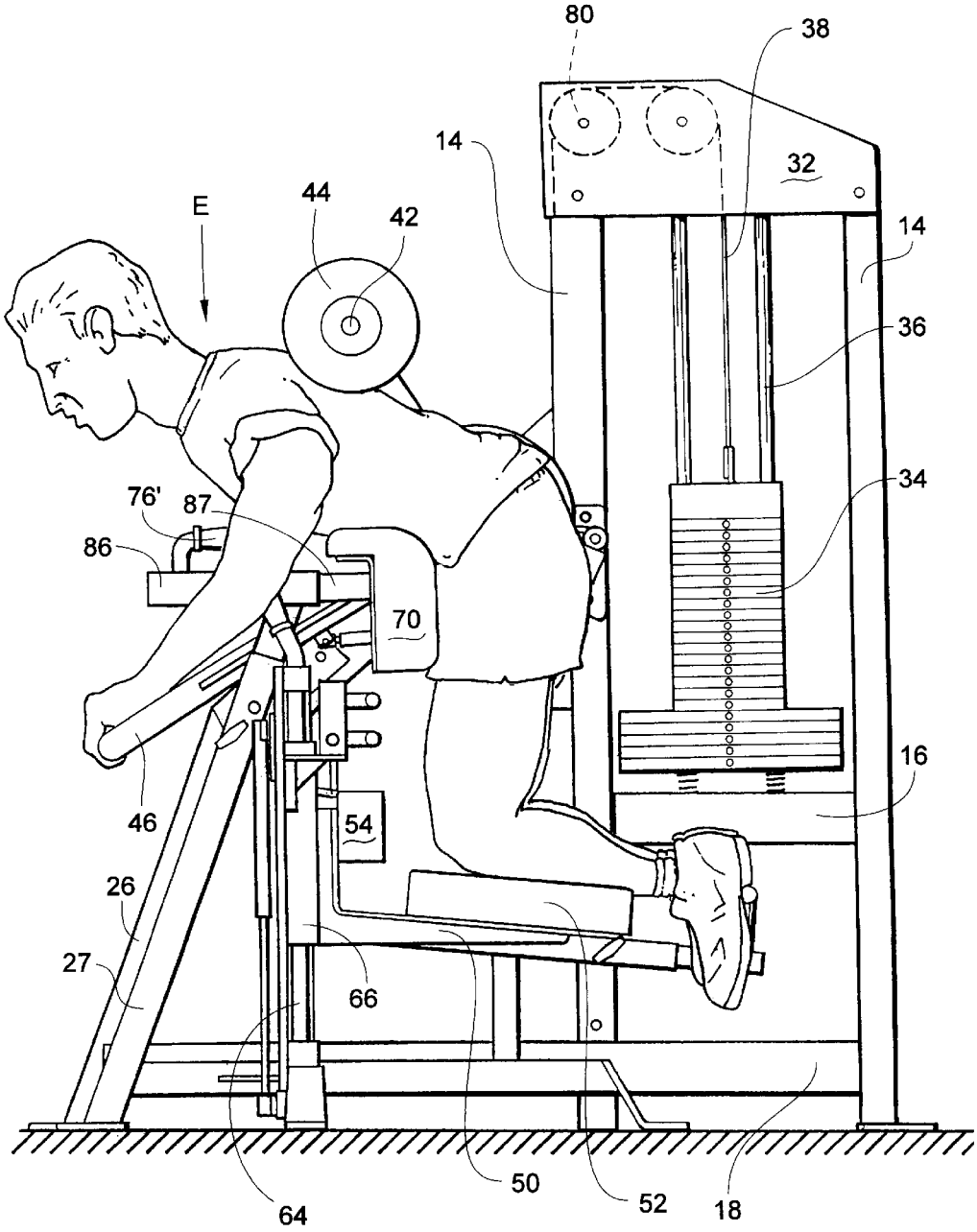
FIG. 9 is a left side view of the apparatus of the present invention illustrating the position at the beginning of each exercise repetition.
Figure 10:
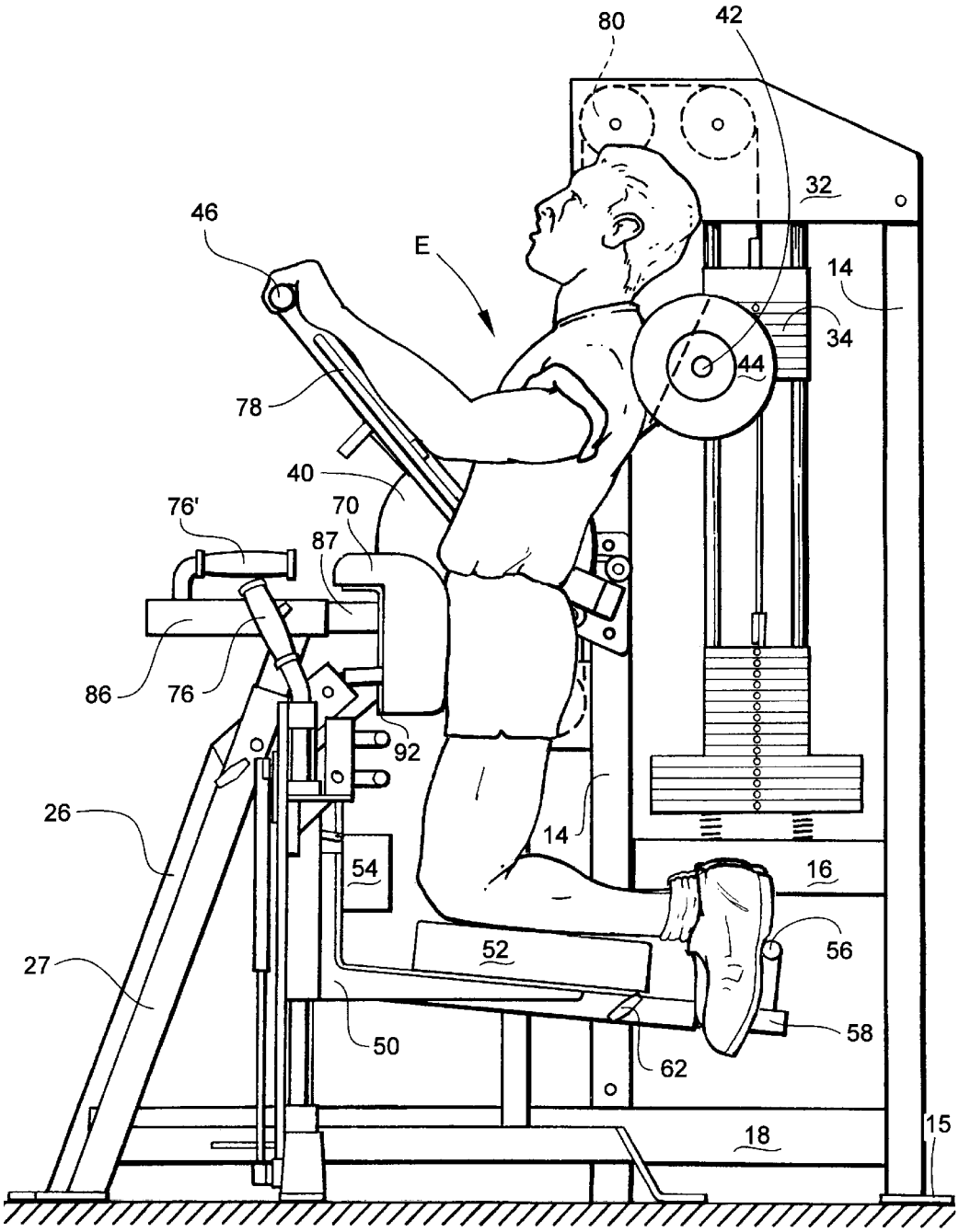
FIG. 10 is a left side view of the exercise apparatus of the present invention illustrating the final position of an exercise repetition using the present invention.
Figure 11:
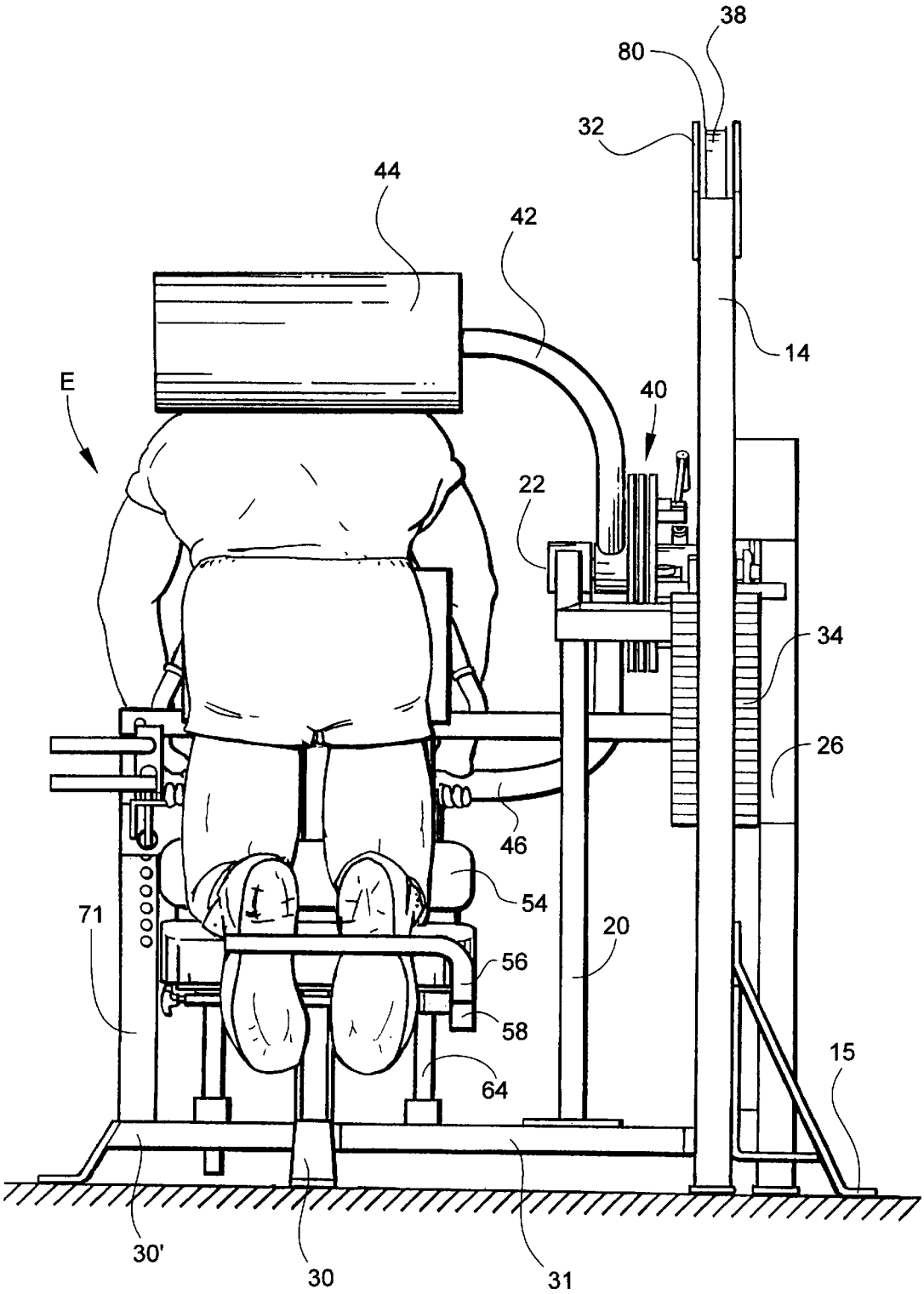
FIG. 11 is a rear view of the apparatus illustrated in FIG. 7 illustrating proper user foot engagement with the apparatus of the present invention.

In order to properly exercise the lower back muscles, the exerciser E should move through a full range of motion extending from a bent forward position as illustrated in FIG. 9 to a bent backward position illustrated in FIG. 10. As can be seen in FIG. 9, the exerciser E has movement of the pelvic girdle blocked and is supported on the lower legs by the kneeling pad 52. The weight elements 34 are in a resting condition. Having previously designated the weight required by the exerciser E to be lifted, the exerciser E bends backward from the initial position shown in FIG. 9 through an arcuate movement to the final position shown in FIG. 10 which causes the desired number of weight elements 34 to rise. Repetition of this movement for a predetermined time period provides substantial, concentrated resistance to movement of the spinae erector muscle group to provide both fitness and therapeutic exercise to those muscles. For people with knee or leg problems, or who otherwise will have problems kneeling on the support platform, the platform may be lowered sufficiently for a person to stand erect thereon and still exercise with substantial effectiveness. Optionally, the device may be fitted with a standing platform in place of the kneeling platform should the need arise. By the above, the present invention uniquely provides isotonic exercise to the spinae erector group to efficiently and substantially exercise those muscles.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An apparatus for exercising the lower back muscles of a user comprising:

a frame;

means mounted to said frame for resisting forward movement of the user's hips to direct the user's gluteus maximus muscles to a relaxed condition and means mounted to said frame for maintaining the user's knees in a flexed condition for directing the user's hamstring muscles to a relaxed condition, wherein said means for resisting forward movement of the user's hips to direct the user's gluteus maximus muscles to a relaxed condition includes a movement resisting member mounted to said frame and disposed for engagement by the front of the pelvic girdle area of a user to block substantial forward movement of the user when operating said apparatus;

lever means mounted to said frame in a disposition for engagement by the upper back of a user for backward and forward user-induced movement of said lever means for exercise with the user's lower back muscles in isolation and with the user's gluteus maximus and hamstring muscles in relaxed condition; and resistance means operatively connected to said lever means for resisting said backward user-induced movement with a predetermined resistive force.

2. An apparatus for exercising the lower back muscles of a user according to claim 1 wherein said movement resisting member is mounted to said frame for contact with the pelvic girdle region of a user kneeling on said apparatus for elimination of loading of the user's hamstring muscles and gluteus maximus muscles during exercise.

3. An apparatus for exercising the lower back muscles of a user comprising:

a frame;

means mounted to said frame for supporting the user in a kneeling position to direct the user's hamstring muscles to a relaxed condition and means mounted to said frame for blocking the user's pelvic girdle thereby eliminating hip joint movement and maintaining the user's gluteus maximus muscles in a relaxed condition, said means for supporting the user in a kneeling position being oriented generally perpendicularly to said means for blocking the user's pelvic girdle;

lever means mounted to said frame in a disposition for engagement by the upper back of a user when the user is supported in a kneeling position on said supporting means for backward and forward user-induced movement of said lever means for exercise of the user's lower back muscles; and resistance means operatively connected to said lever means for resisting said backward user-induced exercise movement with a predetermined resistive force.

4. An apparatus for exercising the lower back muscles of a user according to claim 3 wherein said lever means is pivotally mounted to said frame for pivoting about a pivot axis.

5. An apparatus for exercising the lower back muscles of a user according to claim 4 wherein the pivot axis of said lever means is adjacent the lumbar region of the user when operating said apparatus.

6. An apparatus for exercising the lower back muscles of a user according to claim 4 and further comprising stabilizing means including hand engageable means mounted to said lever means for pivoting with said lever means about said pivot axis, said hand engageable means being disposed for engagement by the hands of a user to stabilize the upper body of the user when operating said lever means.

7. An apparatus for exercising the lower back muscles of a user according to claim 3 wherein said means for blocking the user's pelvic girdle thereby eliminating hip joint movement includes a member mounted to said frame and disposed for engagement by the front of the pelvic girdle area of a user to block forward movement of the user when operating said apparatus.

8. An apparatus for exercising the lower back muscles of a user according to claim 3 and further comprising means mounted to said frame and engageable by the user for stabilizing the user during user-induced movement of said lever means.

9. An apparatus for exercising the lower back muscles of a user according to claim 3 and further comprising means mounted to said frame in a disposition for engagement by the front portions of the user's legs above and adjacent the knees of the user to facilitate stabilization of the user's legs when operating said apparatus.

10. An apparatus for exercising the lower back muscles of a user according to claim 3 wherein said lever means includes means for selectively limiting a range of pivoting movement of said lever means.

11. An apparatus for exercising the lower back muscles of a user comprising:

a frame;

a kneeling platform mounted to said frame for supporting a user in a kneeling position;

means mounted to said frame for preventing forward movement of the hip of a user kneeling on said platform;

lever means pivotally mounted to said frame for movement about a pivot axis and disposed for engagement by the upper back of a user in said kneeling position for backward and forward user-induced movement of said lever means for exercise of the user's lower back muscles; and resistance means operatively connected to said lever means for resisting said backward user-induced movement with a predetermined resistive force.

12. An apparatus for exercising the lower back muscles of a user according to claim 11 wherein the pivot axis of said lever means is adjacent the lumbar region of the user when operating said apparatus.

13. An apparatus for exercising the lower back muscles of a user according to claim 11 wherein said forward hip movement resisting means includes a member mounted to said frame and disposed for engagement by the front of the pelvic girdle area of a user to block substantial forward movement of the user when operating said lever means.

14. An apparatus for exercising the lower back muscles of a user according to claim 11 and further comprising means mounted to said frame and engageable by the user for stabilizing the user during user-induced movement of said lever means.

15. An apparatus for exercising the lower back muscles of a user according to claim 11 and further comprising stabilizing means including hand engageable means mounted to said lever means for pivoting with said lever means about said pivot axis, said hand engageable means being disposed for engagement by the hands of a user to stabilize the upper body of the user when operating said lever means.

16. An apparatus for exercising the lower back muscles of a user according to claim 11 further comprising means mounted to said frame above and adjacent said kneeling platform for engagement by the front portions of the user's legs to block forward movement of the user's legs when operating said apparatus.

17. An apparatus for exercising the lower back muscles of a user according to claim 11 wherein said lever means includes means for selectively limiting the range of pivoting movement of said lever.

18. An apparatus for exercising the lower back muscles of a user comprising:

a frame;

means mounted to said frame for resisting forward movement of the user's hips to direct the user's gluteus maximus muscles to a relaxed condition and means mounted to said frame for maintaining the user's knees in a flexed condition for directing the user's hamstring muscles to a relaxed condition, means mounted to said frame in a disposition for engagement by the front portions of the user's legs above and adjacent the knees of the user to facilitate stabilization of the user's legs when operating said apparatus;

lever means mounted to said frame in a disposition for engagement by the upper back of a user for backward and forward user-induced movement of said lever means for exercise with the user's lower back muscles in isolation and with the user's gluteus maximus and hamstring muscles in relaxed condition; and resistance means operatively connected to said lever means for resisting said backward user-induced movement with a predetermined resistive force.

* * * * *